US011091916B2

(12) United States Patent
Casulleras et al.

(10) Patent No.: US 11,091,916 B2
(45) Date of Patent: Aug. 17, 2021

(54) FACADE ELEMENT HOLDER AND METHOD FOR MOUNTING SAME

(71) Applicant: SFS intec Holding AG, Heerbrugg (CH)

(72) Inventors: Jordi Casulleras, Madrid (ES); Roland Mair, Gotzis (AT)

(73) Assignee: SFS intec Holding AG, Heerbrugg (CH)

( * ) Notice: Subject to any disclaimer, the term of this patent is extended or adjusted under 35 U.S.C. 154(b) by 0 days.

(21) Appl. No.: 16/868,659

(22) Filed: May 7, 2020

(65) Prior Publication Data

US 2020/0354966 A1 Nov. 12, 2020

(30) Foreign Application Priority Data

May 7, 2019 (EM) ..... 19173135

(51) Int. Cl.
*E04F 13/08* (2006.01)

(52) U.S. Cl.
CPC ..... *E04F 13/0832* (2013.01)

(58) Field of Classification Search
CPC .. E04F 13/0851; E04F 13/0832; E04F 13/083
See application file for complete search history.

(56) References Cited

U.S. PATENT DOCUMENTS

2012/0186170 A1* 7/2012 Macdonald ..... E04F 13/083 52/173.3
2017/0306631 A1* 10/2017 Kirk ..... E04F 13/0875
2019/0169855 A1* 6/2019 Czyz ..... E04F 13/0819
2020/0141126 A1* 5/2020 Lehmann ..... E04F 13/083
2020/0173173 A1* 6/2020 Dye ..... E04F 13/14

FOREIGN PATENT DOCUMENTS

CH 690588 10/2000
DE 102007052407 5/2009
DE 102007052407 A1 * 5/2009 ..... E04F 13/0816
DE 202016005362 U1 * 12/2017 ..... E04F 13/0812
DE 102017007324 3/2018
WO WO-2010065034 A2 * 6/2010 ..... E04F 13/083
WO 2017158129 9/2017

* cited by examiner

*Primary Examiner* — Christine T Cajilig
(74) *Attorney, Agent, or Firm* — Volpe Koenig

(57) ABSTRACT

A facade element holder includes first and second profile elements, the first profile element having two sections A and B. Here, section A has a first surface shape X and section B as a second surface shape Y. The second profile element has two sections C and D with a first surface shape X' and a second surface shape Y'. X and X' and Y and Y' have substantially the same contour diametrically oppositely in pairs, the spacings from A to B and from C to D being chosen to be substantially equal. The first and second profile elements can thus inter-engage in a form-fitting manner in section A and C and in section B and D. A method for mounting facade elements with such a facade element holder includes providing first and second profile elements and facade elements, and fitting the second profile elements to the rear side of the facade elements and installing the first profile elements horizontally as outer terminating elements of a substructure on a load-bearing building envelope. Individual facade elements are mounted by the second profile element(s) being brought into engagement with the first profile elements such that a form-fitting connection is achieved.

8 Claims, 3 Drawing Sheets

FACADE ELEMENT HOLDER AND METHOD FOR MOUNTING SAME

INCORPORATION BY REFERENCE

The following documents are incorporated herein by reference as if fully set forth: European Patent Application No. 19173135.5, filed May 7, 2019.

TECHNICAL FIELD

The present invention relates to a facade element holder as part of a system for facade fastening. This facade element holder is suitable, inter alia, for an externally suspended, back-ventilated facade as can frequently be found nowadays in new buildings and renovations.

BACKGROUND

A building envelope is nowadays understood to mean the entirety of all structural parts which close off a building to the outside. In modern residential and commercial building, a building envelope here has to satisfy a large number of functions; thus as a barrier to weather influences, as thermal and acoustic insulation and, last but not least, as a design element which provides a building with its recognition value. An externally suspended facade is understood here to mean a building envelope which, unlike a render layer or coated paint, is not applied directly to the load-bearing outer wall but is fastened thereto at a distance. In the context of this invention, a facade system or facade fastening system is considered to be an assembly consisting of at least one substructure on the load-bearing outer wall, the actual, visible facade elements fastened thereto, and the facade element holder as fastener or connecting element therebetween.

One advantage of externally suspended, back-ventilated facades is that, apart from the receiving points of the substructure, the load-bearing building envelope can be designed to be substantially functionally static. The substructure defines a volume between the statically load-bearing outer wall that can serve to receive thermal insulation and supply lines. A facade element is understood in the present context to mean the structural element which visibly closes off the building envelope to the outside.

PRIOR ART

The prior art discloses a large number of facade variants. In general, an externally suspended facade requires a substructure which specifies the distance between the load-bearing outer wall or building structure and a facade element. For this purpose, it is known to use supporting and spacing elements for load dissipation, the first end of said elements being fastened to the load-bearing outer wall at discrete points. To their other end are fitted longitudinal profiles consisting of steel or aluminum, preferably horizontally and/or vertically largely parallel to the load-bearing building structure. To these profiles in turn are fitted the facade elements via said facade holders.

A frequent requirement is that an externally suspended facade be fastened "invisibly", that is to say that the mechanical connection points between facade elements and substructure are not visible from outside. A solution to this problem must mean no compromises in assembly effort and safety.

It is also important that a facade can also be demounted again. This may be necessary for repair or replacement of individual facade elements or during demolition of the complete facade.

SUMMARY

The object of the invention is therefore to provide a facade system which merges with as few components as possible, is intended to be mounted and adjusted simply and safely and can be fastened invisibly. This is achieved by a facade system and mounting method with one or more features of the invention.

"Facade elements" are understood in the following to mean structural parts which are intended to be fastened as part of a building envelope to a substructure. These facade elements are customarily large-area, planar and have a square or rectangular basic shape. They are frequently manufactured from fiber cement, plastics, metal plates, natural stone, glass or composite materials. They serve for protecting, insulating, cladding and/or decorating the building envelope. Functionally active facade elements such as solar panels, electronic displays or luminous surfaces, are also encompassed.

The holder for such facade elements that is described in the present invention substantially comprises two profile elements which, when mounted as intended, can inter-engage in a form-fitting manner to produce a (hooked-in) suspended connection. For use in building construction, it is important that the connection is releasable.

A facade element holder therefore comprises a first profile element which is configured as a longitudinal profile to be mounted horizontally and as such is or becomes a constituent part, in particular terminating element, of the substructure of a facade fastening. Preferably, it is therefore configured as a longitudinal profile which is mounted horizontally on spacers or spacing elements. The parallel spacing of these horizontally oriented longitudinal profiles is dependent inter alia on the dimensions and the weight of the facade elements and is stipulated in an assembly or laying plan.

A second profile element supplements the first profile element to form the core of the holder. It has the function of an adaptor or hook-in element to be fitted to a facade element. The second profile element is fitted to the rear side of the facade element; this can occur by screwing, riveting, adhesive bonding or in some other known way. The second profile element can be fitted to the facade element as a strip or multiple times as a short portion, depending on the requirement or specification. These profile elements can preferably also be fitted already during the production or fabrication of the facade elements ex works instead of at the assembly site.

In order to ensure the aforementioned form-fitting engagement, the present invention provides that both the first and the second profile element are designed in such a way that they can inter-engage in two regions. What is meant by inter-engaging is that the two profile elements are joined during mounting in such a way that they are connected to one another in a form-fitting manner thereafter. What is meant here by form-fitting connection in the customary definition is that the two profile elements, even without a third element, are inhibited in movement in at least one spatial direction; according to customary understanding, the form-fitting connection has the effect that the facade element, when correctly mounted, is secured against falling down.

The suspended connection after customarily mounting simultaneously produces a force fit (frictional engagement) in the horizontal direction. The securing element described below additionally has the effect that the facade element is also secured horizontally in a form-fitting manner.

In order to ensure the "inter-engagement in two regions", it is necessary—in generalized formulation—for two sections A, B to be present on the first profile element, with section A having a first surface shape X and section B having a second surface shape Y. What is meant here by sections are regions or portions of the profile body which are functionally designed in such a way that, in conjunction with a mating piece or the region of another profile, they can ensure the form-fitting connection. For this purpose, the surface is configured in such a way that the contour thereof corresponds to the contour of the mating piece. This automatically demands that the dimensions of the surfaces are chosen to be similar such that the form-fitting connection is possible.

In concrete terms, the second profile element will thus likewise have two sections C, D, with section C having a first surface shape X' and section D having a second surface shape Y'. In order to achieve the aforementioned form-fitting connection, X and X' and Y and Y' have substantially the same contour diametrically oppositely in pairs. Furthermore, the spacings from A to B and from C to D are chosen to be substantially equal, and the spatial orientation of A and B in the first profile element and of C and D in the second profile element is configured in such a way that the first and second profile elements can inter-engage in a form-fitting manner in section A and section C and in section B and section D.

These are the geometric boundary conditions for harmonizing the two form-fitting regions A/C and B/D with their surface contours or shapes X/X' and Y/Y'.

It is not implied here that the form-fitting connection can be achieved only in one single relative position of A/C or B/D or only in one end position. As explained below with respect to the adjusting element, the form-fitting connection (in the sense of "secured against falling down") can indeed be achieved in different arrangements of A and C or B and D relative to one another.

In the simplest case, the surface shape X and the surface shape Y are configured to be substantially identical, which helps to reduce the production costs.

The first and the second profile elements are preferably manufactured from aluminum, for example in an extrusion process, or alternatively from steel, for example as a stamped/formed part. Depending on admissibility, it is also conceivable to use plastics which can be configured to be fire-retardant, high-melting and/or fiber-reinforced.

A description will be given below of the configuration, arrangement and function of an adjusting element and a securing element. For this purpose, it is advantageous if the second profile element is already prepared for receiving at least one such element, since it improves handling safety and reduces the effort at the assembly site. For this purpose, it is advantageous for a threaded hole to be provided on the second profile element in section C or D. The exact position and orientation will be given to a person skilled in the art from the functional description in FIG. 4. In addition, it can be advantageous to provide a through-hole in the second profile element in section C or D. The threaded hole and/or through-hole can preferably be arranged spaced apart in the profile longitudinal direction.

The aforementioned securing element has the task of securing the mounted facade element against lateral (horizontal) displacement. However, at the same time, the securing element should not adversely affect lifting off/lifting out, that is to say the desired demounting. For this purpose, the securing element is configured as a screw pin. In connection with the invention, what is meant by a screw pin is a fastener which has a short threaded portion which, however, is effective only as a securing means in the first profile element. With correct design and proper mounting, the thread does not engage in the second profile element. As considered ordered from the tip to the head, the screw pin or the securing element has at its first end a drill tip which transitions into a thread-free shank which in turn adjoins a threaded portion which is adjoined by a head configured as a flange and having a force-application means. The threaded portion is thus substantially configured as an under-head thread. During handling, the screw pin can be guided through the above-described (optional) through-hole in the first profile element and is then drilled into the second profile element. The under-head thread is embedded in self-tapping manner in the through-hole in the first profile element and is thus automatically secured when the head comes up against a stop. In other words, although the screw pin plugs into the second profile element and fixes the relative position with respect to the first profile element (against horizontal displacement), it does not prevent the holder being separated, that is to say the first profile element being lifted off, since this movement occurs parallel to the longitudinal axis of the screw pin. Both the drill tip and the thread-free shank act as a pin element. If no through-hole is provided ex works, it is indeed also possible by means of the drill tip to achieve the hole in the first profile element.

In an expedient development, there can be provided an adjusting element which can be configured as a set screw. The latter is introduced into the aforementioned threaded hole and allows the first profile element to be displaced in relation to the second profile element. The self-locking of the thread maintains the position, once selected. In the intended mounted position, a height adjustment of the facade element relatively to the first profile element is thus possible.

The aforementioned form-fitting connection by tailoring the surface shapes X, X' and Y, Y' can be achieved in various ways. Starting from the above-described functional and structural boundary conditions, a preferred configuration can be realized by the surface shape X being formed substantially from three surfaces which are perpendicular to one another and which have external angles $\alpha,\alpha'=90°$. What is meant by this are the outer surfaces of a U-shaped body. In a corresponding manner thereto, the surface shape X' is substantially formed from three surfaces which are perpendicular to one another and which have internal angles $\beta,\beta'=90°$. What is meant by this are the inner surfaces of a U-shaped body.

In summary, a method for mounting facade elements with a facade element holder as described above can thus be described as follows:

a) Providing second profile elements and facade elements, b) Fitting the second profile elements to the rear side of the facade elements.

These steps can, as mentioned, take place in situ or as a process step during the production of the facade elements.

c) Providing first profile elements, d) Horizontally installing the first profile elements as outer terminating elements of a substructure on a load-bearing building envelope.

As mentioned above, the type of fastening of these first profile elements has no influence on the invention. It can occur according to a predetermined laying plan with elements from the prior art.

e) Hooking in individual facade elements by bringing the second profile element(s) into engagement with the first profile elements in such a way that a form-fitting connection is achieved.

In a preferred procedure, the method is supplemented by:

f) Aligning the facade element by means of an adjusting screw, and g) Securing the facade element by pinning a second profile element onto the first profile element by means of a screw pin.

By virtue of the above-described function of the screw pin, it is equivalently possible to swap steps f) and g).

BRIEF DESCRIPTION OF THE DRAWINGS

The figures show the invention in various views.

DETAILED DESCRIPTION

Figure 1:
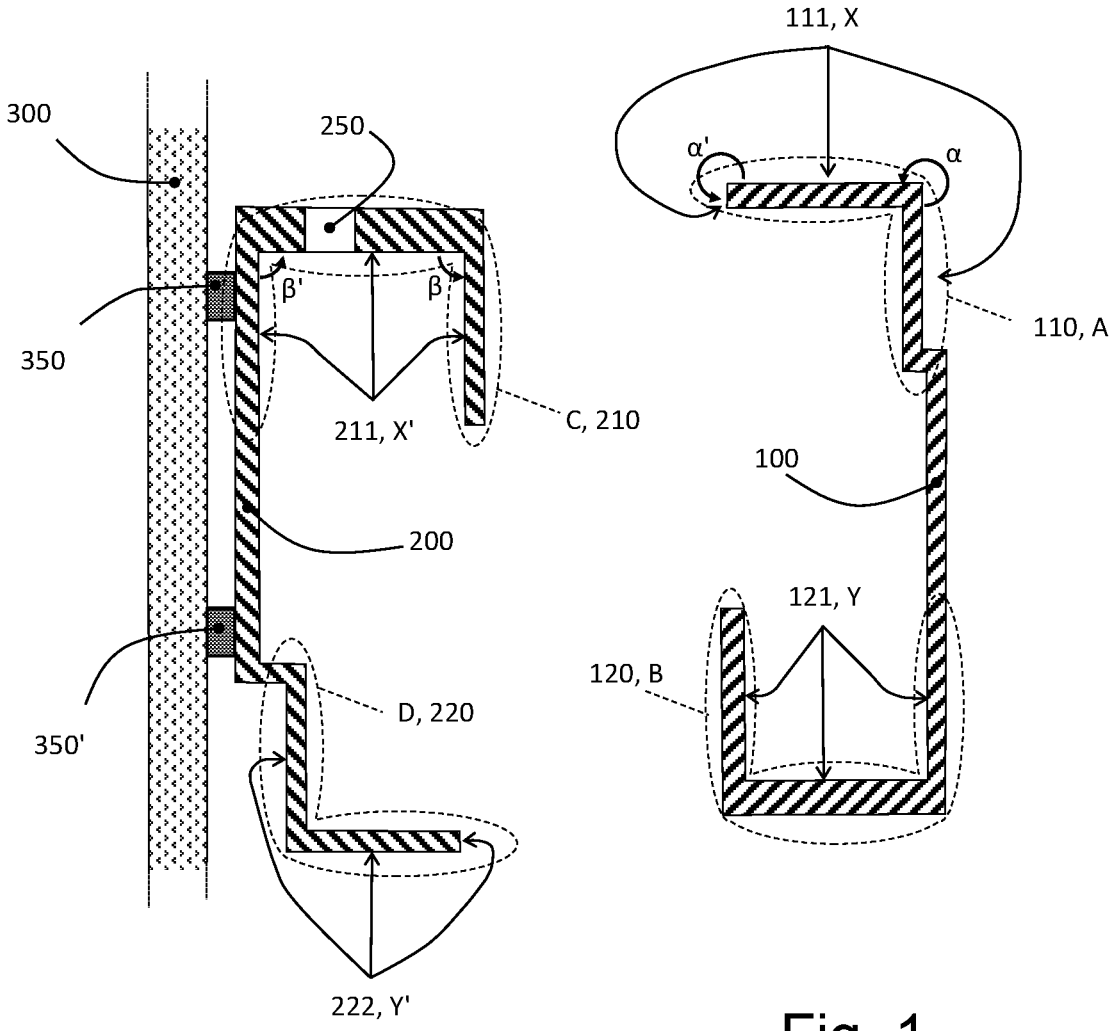
FIG. 1 shows the profile elements 100 and 200 in the unmounted state next to one another, in cross section.

FIG. 1 shows in cross section, in the left half of the image, a profile element 200 in a state of exemplary connection, via spacing pieces 350, 350' to a facade element 300. With reference to the image, "upper" or "at the top" corresponds to "upper" or "at the top" in the mounting situation. The upper end comprises the section C, 210, which substantially forms an inverted U. The inner surfaces of the U form the surface shape X', 211. The lower end of the profile element 200 forms the section D, 220 with the surface shape Y', 222. D is substantially formed as an L-shaped component. Nevertheless, as indicated by the arrows, the component comprises three surfaces which can contribute to the form-fitting connection. Also included here is the outer terminating surface of the lower leg of the L-shaped component (section D).

Figure 4:
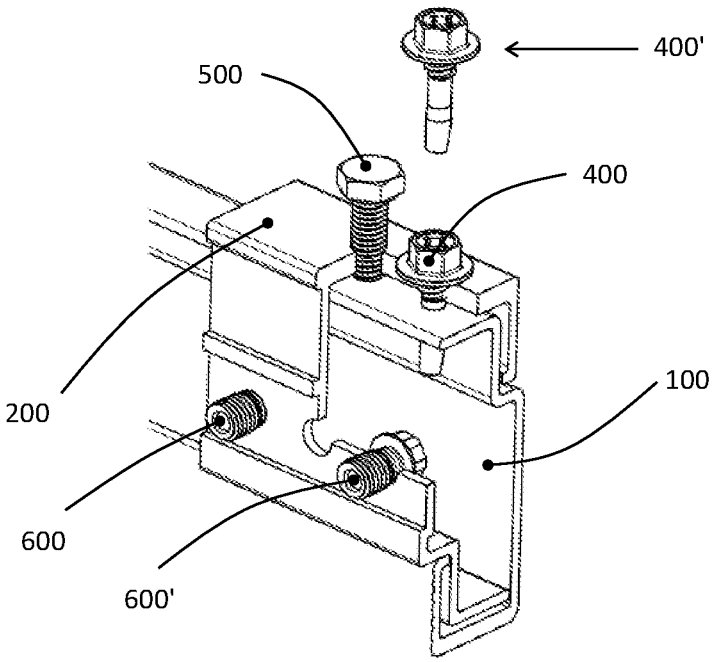
FIG. 4 shows a preferred embodiment of a holder.

Depicted alongside is the mating piece, a profile element 100. It will be clear to the observer that, in the depicted special case, the cross-sectional profile of element 200 represents the profile of element 100 rotated through 180°. However, this is not mandatory, as the comparison with FIG. 4 shows. Analogously to the profile element 200, the profile element 100 has a section A, 110, which is L-shaped in form and, as surface shape X, 111, analogously provides three surfaces at the top. The lower end of profile 100, section B, 120 has the surface shape Y or 121. The formation as a trough (Y, X') and L-angles (X, Y') allows adjustment of the two elements 100, 200 with respect to one another during mounting without losing the form-fitting connection. The position of a threaded hole is marked by reference sign 250.

Figure 2A:
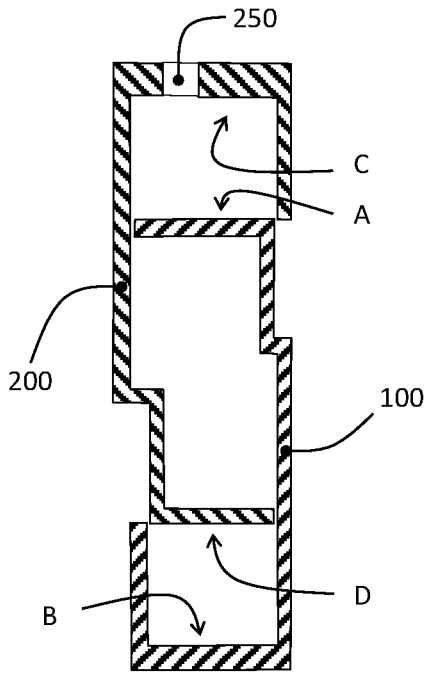
FIGS. 2A-2C show three different stages of joining or inter-engaging two profile elements.
Figure 2B:
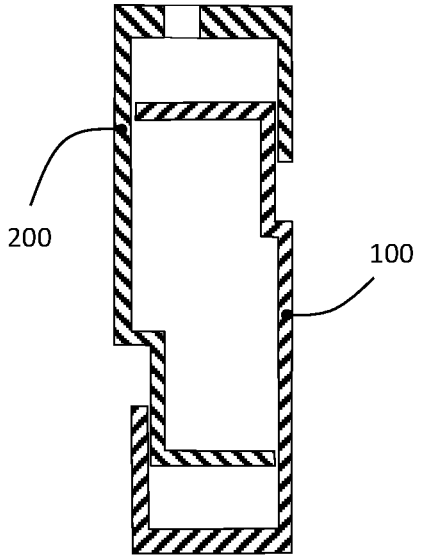
Figure 2C:
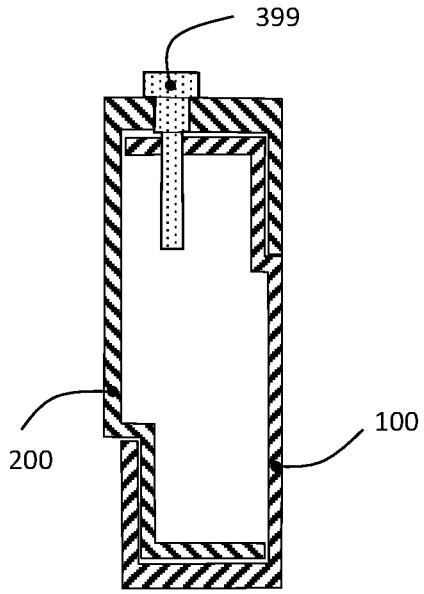

The sequence of drawings 2A to 2C shows the operation of the inter-engagement or the mounting of two profile elements as shown in FIG. 1. FIG. 2A shows how the sections A-C and B-D are aligned with one another, FIG. 2B shows the production of the form-fitting connection, and FIG. 2C shows how the two profile elements inter-engage in the end position. In FIG. 2*c*, the reference sign 399 (securing element) schematically indicates the position of a screw pin whose under-head thread engages in the profile element 200 and fixes the relative position. The fact that the pin is free from a thread (apart from the under-head portion in engagement with profile element 200) ensures that, in a reversal of the mounting operation, the profile element 200 can be lifted out of the profile element 100 without requiring the screw pin/screwing element 399 to be loosened.

FIG. 2C shows a complete form-fitting connection between the two profile elements 100, 200 without the use of an adjusting screw 500 (FIG. 4). In FIG. 2C, therefore, all three surfaces Y, 121 with Y', 222 are involved in the form-fitting connection. If an adjusting screw is used, a situation as shown in FIG. 2B is possible. Only 2 of the 3 surfaces are in engagement, with nevertheless the form-fitting connection being effectively achieved.

Figure 3:
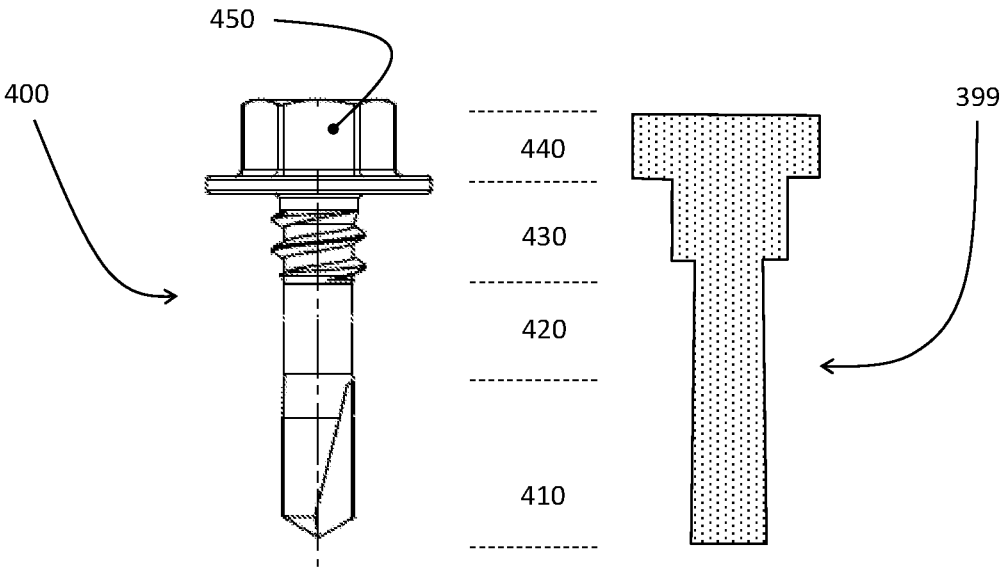
FIG. 3 illustrates a screw pin 400.

FIG. 3 explains the construction of a screw pin 400 by comparison with the securing element 399. Starting from the head 440 with a force-application means 450, there adjoins an under-head thread portion 430. Subsequently shown are the thread-free shank 420 and the drill tip 410. The diameter of the drill tip 410 and diameter of the thread-free shank 420 are selected such that they jointly allow pinning.

FIG. 4 shows a perspective view of a partially cutaway configuration of an actual facade element holder. The two profile elements 100 and 200 are in engagement and in form-fitting connection. The adjusting element 500, anchored in a threaded hole of profile element 200, makes it possible, by turning, to adjust the vertical spacing of the two elements without forfeiting the form-fitting connection. The screw pin 400 is shown once as being anchored and once in axial extension from the mounting position.

600 and 600' designate two fasteners which could connect the profile element 200 to a facade element (not shown here). This type of connection with the facade element is only one of many possible types.

The features of the invention that are disclosed in the above description, in the drawings and in the claims may be essential, both individually and in any desired, but technically expedient or advantageous combination, for implementing the invention.

The invention claimed is:

1. A facade element holder, comprising a first profile element, configured as a longitudinal profile configured to be mounted horizontally and as a constituent part of a substructure of a facade fastening;

a second profile element, configured as an adaptor to be fitted to a facade element;

the first profile element having first and second sections (A,B), with the first section (A) having a first surface shape (X) and the second section (B) having a second surface shape (Y);

the second profile element having third and fourth sections (C,D), with the third section (C) having a first surface shape (X') and the fourth section (D) having a second surface shape (Y');

the first surface shape (X) of the first section being configured to be received in the first surface shape (X') of the third section, and second surface shape (Y) of the fourth section being configured to be received in the second surface shape (Y) of the second section, the first surface shape (X) of the first section is configured to be substantially the same as the second surface shape (Y') of the fourth section, and the second surface shape (Y) of the second section is configured to be substantially the same as the first surface shape (X') of the third section;

spacings from the first and second sections (A to B) and from the third and fourth sections (C to D) are substantially equal, a spatial orientation of the first and second sections (A and B) in the first profile element and of the third and fourth sections (C and D) in the second profile element is arranged such that the first and second profile elements are inter-engagable in a form-fitting manner at the first section (A) and the third section (C) and at the second section (B) and the fourth section (D), and a securing element, configured as a screw pin, the screw pin having a drill tip at a first end thereof which transitions into a thread-free shank, said thread-free shank adjoins a threaded portion which is adjoined by a head configured as a flange and having a force-application configuration, said threaded portion being configured to only be secured in the first profile element and not engaging in the second profile element to fix a relative position of the second profile element with respect to the first profile element against horizontal displacement.

2. The facade element holder as claimed in claim 1, wherein the second profile element has a threaded hole in the third section (C) or the fourth section (D).

3. The facade element holder as claimed in claim 2, wherein the first profile element has a through-hole in first section (A) or the second section (B).

4. The facade element holder as claimed in claim 1, further comprising an adjusting element, configured as a set screw.

5. The facade element holder as claimed in claim 1, wherein the first surface shape (X) of the first section substantially comprises three surfaces which are perpendicular to one another and which have external angles $\alpha$, $\alpha'=270°$.

6. The facade element holder as claimed in claim 5, wherein the first surface shape (X) of the third section substantially comprises three surfaces which are perpendicular to one another and which have internal angles $\beta,\beta'=90°$.

7. A method for mounting facade elements with the facade element holder as claimed in claim 1, comprising the following steps: a) providing the second profile elements and the facade elements, b) fitting the second profile elements to a rear side of the facade elements, c) providing the first profile elements, d) horizontally installing the first profile elements as outer terminating elements of the substructure on a load-bearing building envelope, e) hooking in individual ones of the facade elements by bringing the second profile element(s) into engagement with the first profile elements such that a form-fitting connection is achieved.

8. The method as claimed in claim 7, further comprising the steps: f) aligning the facade element by an adjusting screw, and g) securing the facade element against horizontal displacement by pinning the second profile element onto the first profile element by the screw pin.

* * * * *